US011383897B2

(12) United States Patent
Lalier

(10) Patent No.: US 11,383,897 B2
(45) Date of Patent: Jul. 12, 2022

(54) CLOSURE

(71) Applicant: Conopco, Inc., Englewood Cliffs, NJ (US)

(72) Inventor: Gregory Lalier, Brookfield, CT (US)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 16/957,370

(22) PCT Filed: Dec. 21, 2018

(86) PCT No.: PCT/EP2018/085791
§ 371 (c)(1),
(2) Date: Jun. 23, 2020

(87) PCT Pub. No.: WO2019/129567
PCT Pub. Date: Jul. 4, 2019

(65) Prior Publication Data

US 2020/0331664 A1 Oct. 22, 2020

Related U.S. Application Data

(60) Provisional application No. 62/611,502, filed on Dec. 28, 2017.

(30) Foreign Application Priority Data

Mar. 1, 2018 (EP) ..... 18159378

(51) Int. Cl.
*B65D 47/20* (2006.01)
*B65D 55/02* (2006.01)

(52) U.S. Cl.
CPC ..... *B65D 47/2006* (2013.01); *B65D 55/02* (2013.01); *B65D 2215/04* (2013.01)

(58) Field of Classification Search
CPC . B65D 47/2006; B65D 55/02; B65D 2215/04
See application file for complete search history.

(56) References Cited

U.S. PATENT DOCUMENTS 4,022,352 A 5/1977 Pehr
4,209,100 A 6/1980 Uhlig
(Continued)

FOREIGN PATENT DOCUMENTS

CN 1284925 2/2001
CN 101549769 10/2009
(Continued)

OTHER PUBLICATIONS

Search Report and Written Opinion in EP18159378; dated Sep. 10, 2018.
(Continued)

*Primary Examiner* — Frederick C Nicolas
(74) *Attorney, Agent, or Firm* — Gerard J. McGowan, Jr.

(57) ABSTRACT

A pivotable disc closure actuator, a closure including the actuator and the closure combined with a bottle or other container. The actuator includes a closing surface which includes a product dispensing opening at a front thereof, at least two pivots on the closing surface, an extension panel extending from a peripheral wall of the closing surface and having a locking and an unlocking position, the pivots being intermediate the product opening and the extension panel, and the extension panel having a latch member extending inwardly toward the closing surface when the extension panel is in the locked position. The closure may include a closure base which may in turn include a cutout or opening in its outer wall. In its locked position the extension panel may rest on a surface of the cut out or outer wall to prevent the actuator from rotating from its closed position to an open position.

15 Claims, 4 Drawing Sheets

(56) References Cited

U.S. PATENT DOCUMENTS

| | | | | |
|---|---|---|---|---|
| 4,533,058 | A | 8/1985 | Uhlig | |
| 5,236,107 | A | 8/1993 | Spaanstra | |
| 5,251,793 | A | 10/1993 | Bolen, Jr. et al. | |
| 5,284,264 | A | 2/1994 | Gross | |
| 5,314,093 | A * | 5/1994 | Gross | B65D 50/067 215/235 |
| 5,346,100 | A * | 9/1994 | Lay | B65D 47/2006 222/153.06 |
| 5,395,015 | A | 3/1995 | Bolen, Jr. et al. | |
| 5,622,284 | A | 4/1997 | Sawicki | |
| 5,709,318 | A * | 1/1998 | Oder | B65D 47/2006 222/153.06 |
| 5,918,777 | A * | 7/1999 | Flak | B65D 47/2006 222/212 |
| 6,029,866 | A | 2/2000 | Wood et al. | |
| 6,152,329 | A | 11/2000 | Rosenthal et al. | |
| 6,343,725 | B1 | 5/2002 | Lohrman | |
| 6,896,160 | B2 | 5/2005 | Kaufman et al. | |
| 6,971,547 | B2 * | 12/2005 | Englert | B65D 47/2006 222/1 |
| 7,404,495 | B2 * | 7/2008 | Keung | B65D 47/0804 215/216 |
| D587,969 | S | 10/2009 | Gilbert | |
| D624,357 | S | 9/2010 | George | |
| 7,975,883 | B2 | 7/2011 | Laib et al. | |
| 8,074,849 | B2 | 12/2011 | Domoy | |
| 8,167,156 | B2 * | 5/2012 | Milante | B65D 50/045 215/217 |
| D690,559 | S | 1/2013 | Lane | |
| 8,960,490 | B2 * | 2/2015 | Carlile | B65D 47/249 220/832 |
| D749,363 | S | 2/2016 | Tacker et al. | |
| D748,949 | S | 9/2016 | Long, Sr. | |
| 9,637,626 | B2 | 5/2017 | Domoy et al. | |
| 9,914,567 | B2 | 3/2018 | Brem et al. | |
| 10,669,082 | B1 * | 6/2020 | Meshberg | B65D 43/26 |
| 10,689,169 | B1 * | 6/2020 | Meshberg | B65D 50/046 |
| 2004/0112927 | A1 * | 6/2004 | Kaufman | B65D 47/2006 222/531 |
| 2004/0026465 | A1 | 12/2004 | Klopfer | |
| 2006/0231518 | A1 | 10/2006 | Suffa | |
| 2007/0075030 | A1 | 4/2007 | Delli Venneri | |
| 2008/0190952 | A1 * | 8/2008 | Strub | B65D 83/0472 221/2 |
| 2014/0048549 | A1 | 2/2014 | Wille | |
| 2014/0034644 | A1 | 6/2014 | Wahl | |
| 2016/0200485 | A1 | 7/2016 | Quinones et al. | |
| 2016/0297583 | A1 * | 10/2016 | Staeben | B65D 47/0804 |
| 2019/0092539 | A1 * | 3/2019 | Phillips | B65D 55/024 |

FOREIGN PATENT DOCUMENTS

| | | | | |
|---|---|---|---|---|
| CN | 105492332 | | 4/2016 | |
| CN | 105905422 | | 8/2016 | |
| EP | 926075 | A1 * | 6/1999 | B65D 47/2006 |
| EP | 0990593 | | 9/1999 | |
| EP | 1460000 | | 9/2004 | |
| EP | 2559632 | | 2/2013 | |
| EP | 2424785 | | 3/2013 | |
| FR | 2771386 | | 5/1999 | |
| GB | 2231036 | A * | 11/1990 | B65D 47/2006 |
| JP | 2018090285 | | 6/2018 | |
| WO | WO8903363 | | 4/1989 | |
| WO | WO9422733 | | 10/1994 | |
| WO | WO9516633 | | 6/1995 | |
| WO | WO9732791 | | 9/1997 | |
| WO | WO9936328 | | 7/1999 | |
| WO | WO0242174 | | 5/2002 | |
| WO | WO03086891 | | 10/2003 | |
| WO | WO2004054921 | | 7/2004 | |
| WO | WO2004071882 | | 8/2004 | |
| WO | WO-2011022795 | A2 * | 3/2011 | B65D 47/2018 |
| WO | WO2012110335 | | 8/2012 | |
| WO | WO2017046186 | | 3/2017 | |
| WO | WO-2019129567 | A1 * | 7/2019 | B65D 55/02 |

OTHER PUBLICATIONS

Search Report and Written Opinion in PCTEP2018085791; dated Mar. 11, 2019.

Search Report and Written Opinion in EP18194762; dated Mar. 22, 2019.

Search Report and Written Opinion in EP19155612; dated Aug. 30, 2019.

Search Report and Written Opinion in PCTEP2019074004; dated Nov. 19, 2019.

Search Report and Written Opinion in PCT/EP2020/050230; dated May 15, 2020.

Co-pending U.S. Appl. No. 17/275,301, filed Mar. 1, 2021, entitled Flip Top Closure and Container.

* cited by examiner

CLOSURE

BACKGROUND OF THE INVENTION

The integrity of closures on bottles and other container has always been a concern to consumer goods manufacturers. Leakage of product during shipping can be a costly problem. Also, leakage of product in the hands of consumers is not conducive to repeat purchase.

Leakage concerns are magnified in the current world of e-commerce. It is somewhat easier to ensure intact shipment of large numbers of bottles together than it is to secure the product form leakage during shipment of individual bottles from e-commerce retailers or even for e-commerce shipment from the manufacturer. Likewise, transport of a container by a consumer after she has opened it can be problematic and result in product leakage.

A popular type of closure for consumer goods such as shampoos, body washes, skin creams, etc. is the disc closure wherein a disc at the top of the closure rotates between an open and a closed position. With this type of closure care needs to be taken to ensure that the disc does not rotate open during shipment.

Various types of disc and other type closures are described in the literature. Puderbach et al. WO2017/046186 discloses a dispensing closure comprising a base and an actuator disc pivotally mounted on the base with two pivots. A tamper evident strip 24 is frangibly connected to the lid sidewall. The strip prevents movement of the lid but the act of pressing down on depression 25 causes the strip to be broken away from the sidewall. The strip is automatically separated from the lid as it is forced down against the notch.

Oder U.S. Pat. No. 5,709,318 discloses a toggle dispensing lid having an integral locking switch attached to the closure body. The integral locking switch includes at least two living hinges so that it may be moved between locked and unlocked positions thereby permitting movement of the dispensing lid between closed and product dispensing positions.

Lay WO 95/16633 discloses a toggle action dispensing closure. A cam 98 frictionally engage a wall of closure and serves to stabilize an actuator as it is pivoted. Frictional engagement of the cam maintains the actuator in the titled, open position. A post 110 is provided to prevent accidental movement of the actuator to the open position. A force equal to or greater than a predetermined force, such as that applied by a consumer to open the closure, will drive a wall against post 110 with a force sufficient to sever the abutment.

Englert et al. WO2004071882 discloses a disc top dispensing closure having an actuator which is pivotable about a pivot axis. The actuator is pivotable about a locked position and an unlocked position. A tab 80 and a recess 82 cooperate with each other so that when they are aligned the actuator is pivotable open but when they are not aligned the actuator is not pivotable between the open and closed position. The consumer rotates the actuator between the unlocked position wherein the tab and recess are aligned and the locked position. Kaufman et al. WO2004/054921 is similar.

Rosenthal et al. U.S. Pat. No. 6,152,329 discloses a closure cap having a top plate pivotally attached to a body, for movement between open and closed positions. A locking lever is provided having a fulcrum so that the upper end of the locking lever can be located in the path of movement of the top plate when it is closed to thereby obstruct movement of the top plate to the open position.

Wood et al. U.S. Pat. No. 6,029,866 discloses a dispensing structure having a pivoting actuator. The actuator may include a rearwardly extending angled cam 92 for engaging a protuberance 93. The cam slides against the protuberance on the peripheral wall and serves to stabilize the actuator as it is being pivoted. The cam provides a frictional engagement to maintain the actuator in the tilted, open position.

Gross et al. U.S. Pat. No. 5,314,093 discloses a toggle action dispensing closure having a locking ring which in one position in which an abutment member lies under the actuator engaging a tab to prevent pivoting of the actuator to the open position and the locking ring including a second position wherein the locking ring abutment member is clear of the actuator engagement tab to permit pivoting of the actuator to the open position.

Sawicki U.S. Pat. No. 5,622,284 discloses a child resistant cap having a partial top wall preventing one from impressing effective opening forces on a press to open section of the actuator except using a probe acting through a restricted opening in the top wall.

Among dispensers disclosing containers having a closure and a fastener are Tacker et al. U.S. D749,363, Wahl US2014/0034644, and Lane, U.S. D690,559.

Vollers WO 022795 discloses a hinged disk top closure with a locking device.

Kaufman et al. U.S. Pat. No. 6,896,160 discloses a pivotable disc top dispensing closure. The actuator is rotatable between a locked position and an unlocked position.

Additional dispensers include Long et al. U.S. Design Pat. No. 748,949, Laburu EP2559632, Wille WO2012/110335, George U.S. D624,357, Gilbert U.S. D587,969, Habermann EP1460000 discloses a hinged closure having grip lug (22) connected to a cover (20) in a pivoted manner by way of a film hinge (34). Klopfer WO02/42174, Mueller et al. WO 94/22733, Spaanstra U.S. Pat. No. 5,236,107, Moore et al. WO 89/03363, and Gross U.S. Pat. No. 5,284,264.

SUMMARY OF THE INVENTION

The invention is directed to a pivotable disc closure actuator, to a closure including the actuator and to the closure combined with a bottle or other container. The actuator includes a closing surface comprising a product dispensing opening at a front thereof, at least two pivots on the closing surface, an extension panel extending from a peripheral wall of the closing surface and having a locking and an unlocking position, the pivots being intermediate the product opening and the extension panel, and the extension panel having a latch member extending inwardly toward the closing surface when the extension panel is in the closed position.

The closing surface of the adaptor is generally circular, the opening is within a first arc of 120 degrees at the front of the closing surface, the extension panel is within a second arc of 120 degrees at a rear end of the closing surface, and the pivots are each within third and fourth arcs of 60 degrees each on opposite sides of the closing surface, the third and fourth arcs being intermediate the first and second arcs.

In accordance with one aspect of the invention, the pivotable disc closure actuator further includes a latch retainer for securing the panel extension and keeping the closing surface in the closed position. The actuator may comprise an aperture or indentation for receiving the latch to assist in retaining the latch. The extension panel is preferably attached to the actuator using a living hinge.

The actuator will generally be combined with a closure base which includes an opening suitable for receiving the pivotable adaptor, at least two surfaces on which the pivots can rest when the closing surface is received within the closure base, the combined pivotable closure and closure base further comprising a latch retainer on one or both of the pivotable closure and closure base suitable for receiving and securing the latch member when the extension panel is in the closed position.

The closure base of the invention may include a cut out or opening in an outer wall and the extension panel may rests on a surface of the outer wall cut out or opening when the actuator is in the locked position.

For a more complete understanding of the above and other features and advantages of the invention, reference should be made to the following detailed description of preferred embodiments and to the accompanying drawings.

DETAILED DESCRIPTION OF THE INVENTION

Figure 1:
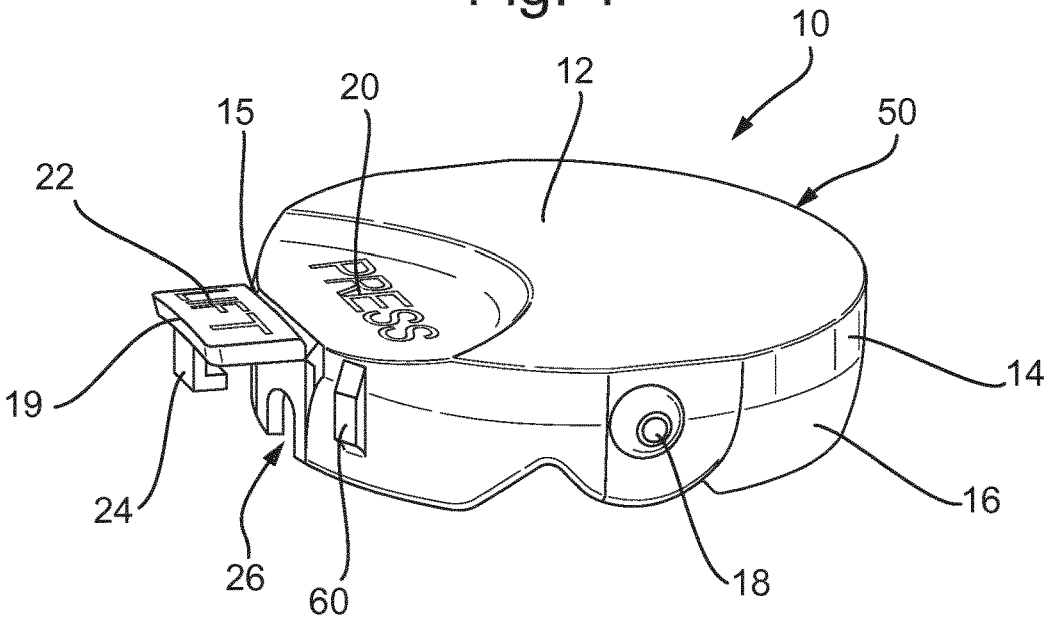
FIG. 1 is a perspective view of the actuator of the closure of the invention in the unlocked position.
Figure 2:
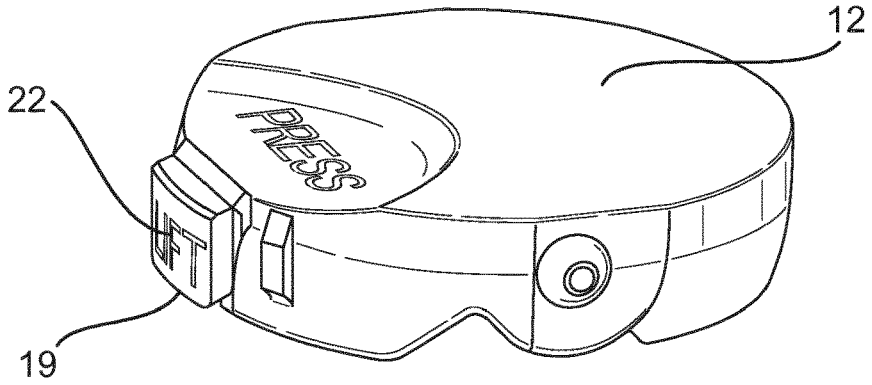
FIG. 2 is a perspective view of the actuator of FIG. 1 in the locked position.

Closure actuator 10 comprises a disc closing surface 12 having a generally circular finger indentation 20. The actuator 10 includes a closing surface comprising a product dispensing opening 50 at a front thereof, An upper skirt 14 depends from surface 12 and a tapered lower skirt 16 depends from upper skirt 14. Rounded pivot member 18 extends outwardly from upper and lower skirts 14, 16; a second rounded pivot (not shown) extends from outwardly from the opposite side of the actuator.

Figure 3:
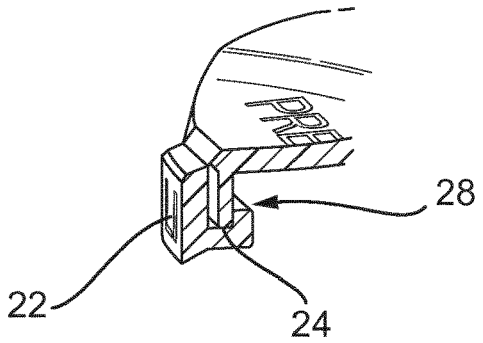
FIG. 3 is an isolated view of the locking mechanism of FIG. 2.
Figure 4:
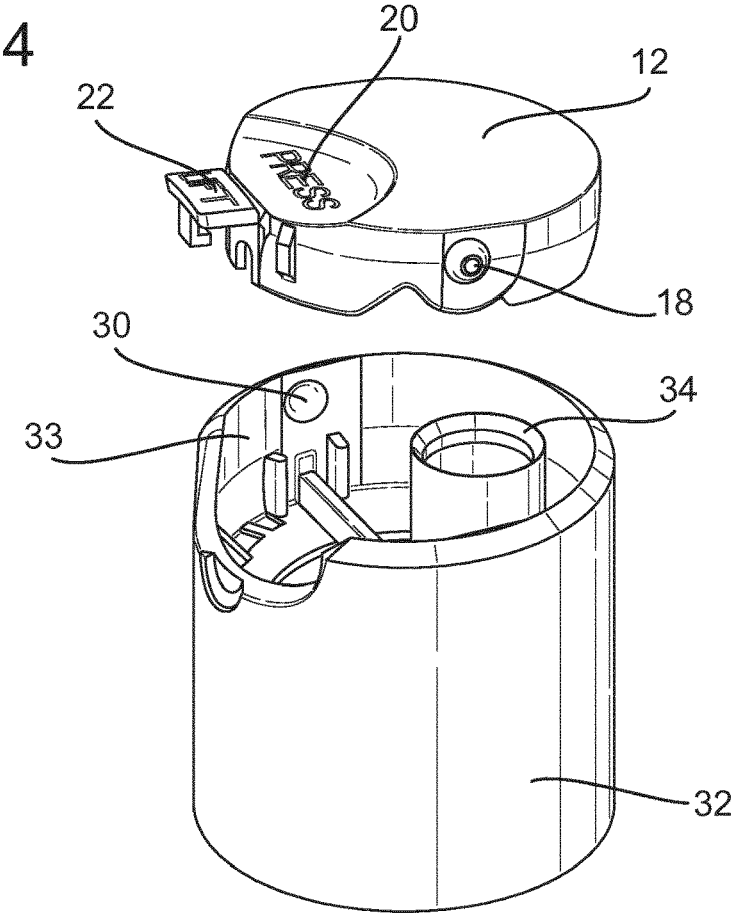
FIG. 4 is a perspective view from the front and the side of the actuator of the invention shown above the closure body.
Figure 5:
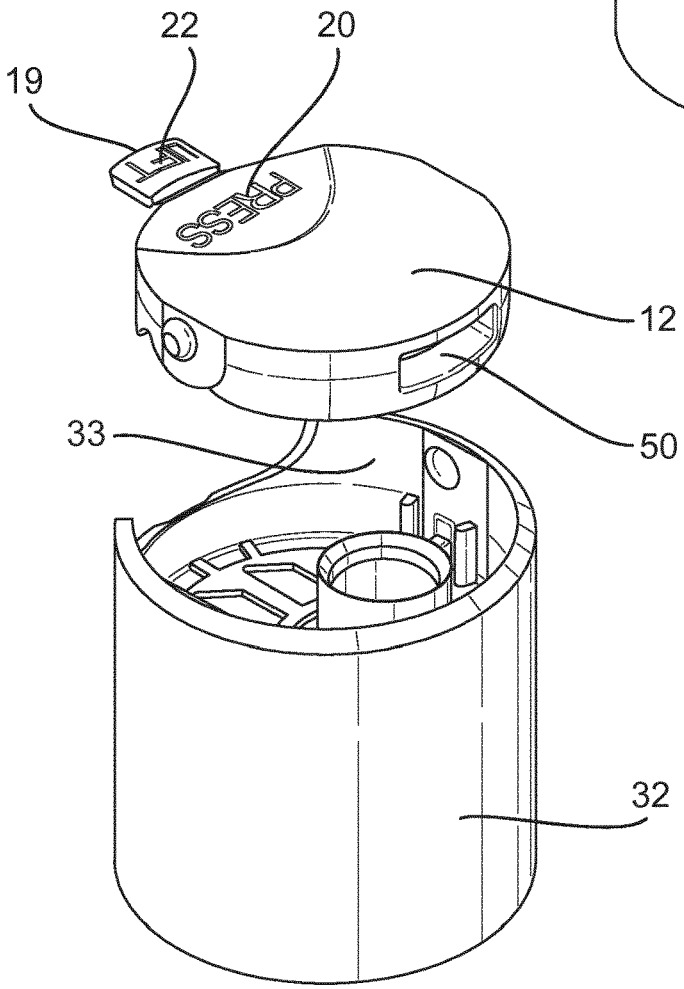
FIG. 5 is a perspective view of the actuator and closure body of FIG. 4 taken from the rear and one side.

Extension panel 22 is connected to upper skirt 14 adjacent finger indentation 20 by living hinge 15. In the unlocked position seen in FIG. 1, panel 22 extends outwardly perpendicular to skirts 14, 16. Extending perpendicularly to panel 22 is L-shaped latch 24, best seen in the locked position in FIG. 3. In the locked position Latch 24 extends inwardly toward actuator 10 and terminates in upwardly extending integral retaining tab 28.

Skirt 16 includes latch receiving/retaining aperture 16 beneath hinge 15, which aperture is illustrated in a generally semicircular shape.

Lower closure body 32 is illustrated as generally cylindrical comprising a generally cylindrical outer wall 31 and includes on its inner wall 33 pivot-receiving semicircular depression 30. A second pivot receiving depression (not shown) is located on the opposite inner wall. Inner wall 33 snugly receives tapered lower skirt 16. One or more tabs 60 facilitate a friction fit for the adaptor with inner wall 33 to assist in retaining the actuator 10 in the open position. Lower body 32 includes circular product passage 34 for conveying product from a bottle (not shown) to the exterior of the closure. Pivot members 18 on actuator 10 pivot in depressions 30 to permit the actuator to pivot between a closed position wherein product cannot be dispensed from the package (seen in FIG. 6) and an open position (seen in FIG. 7) wherein product can be dispensed from the package.

Lower closure body 32 outer wall 31 includes a generally semicircular cutout 40, which may alternatively be an opening, adjacent depression 20 to accommodate extension panel 22, as will be explained below.

As mentioned above, inadvertent opening of closures and attendant product leakage pose a special problem for shipping products ordered through e-commerce. The closure of the invention solves this problem by including extension panel 22, living hinge 15 and latch 24. When it is desired to permit the opening of the actuator, extension panel 22 is in the open position seen in FIGS. 1, and 4-6. In this position, force from a consumer's finger can be impressed on depression 20 to cause the actuator to open.

Figure 8:
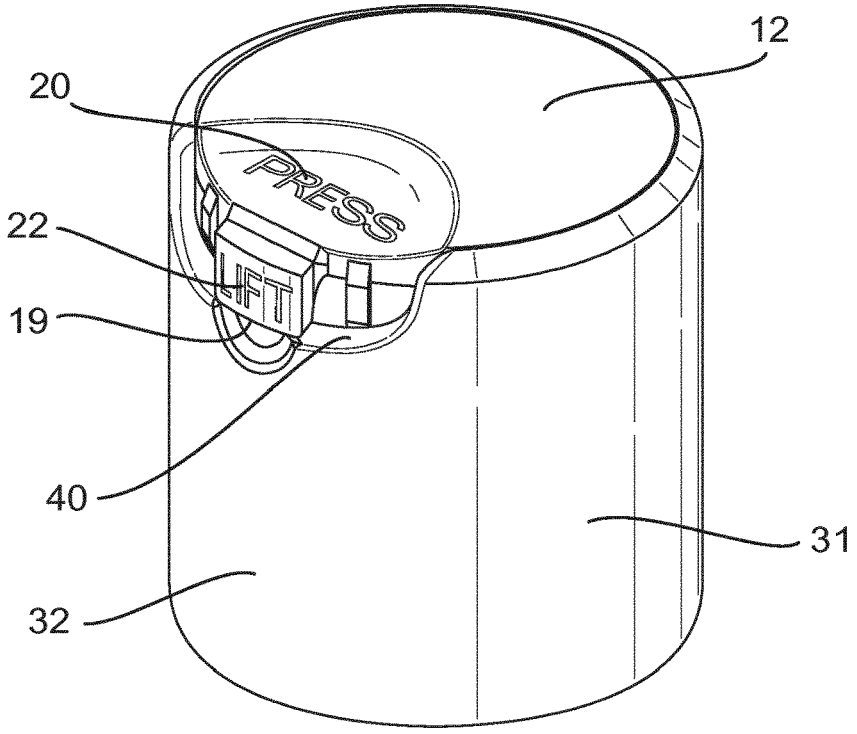
FIG. 8 is a perspective view of the actuator in place on the closure body in the locked and actuator-closed position.

When it is desired to ship or otherwise transport the container, extension panel 22 is pressed downwardly, rotating on living hinge 15, so that latch 24 passes into aperture 26 and retaining tab 28 is disposed interior of the upper and/or lower skirts and keeps the extension panel in the locked position. As can be seen in FIG. 8, in the locked position, bottom surface 19 of extension panel 22 contacts the bottom of cutout 40 thereby preventing force imposed on depression 20 from rotating actuator 10 out of the closed position.

Figure 6:
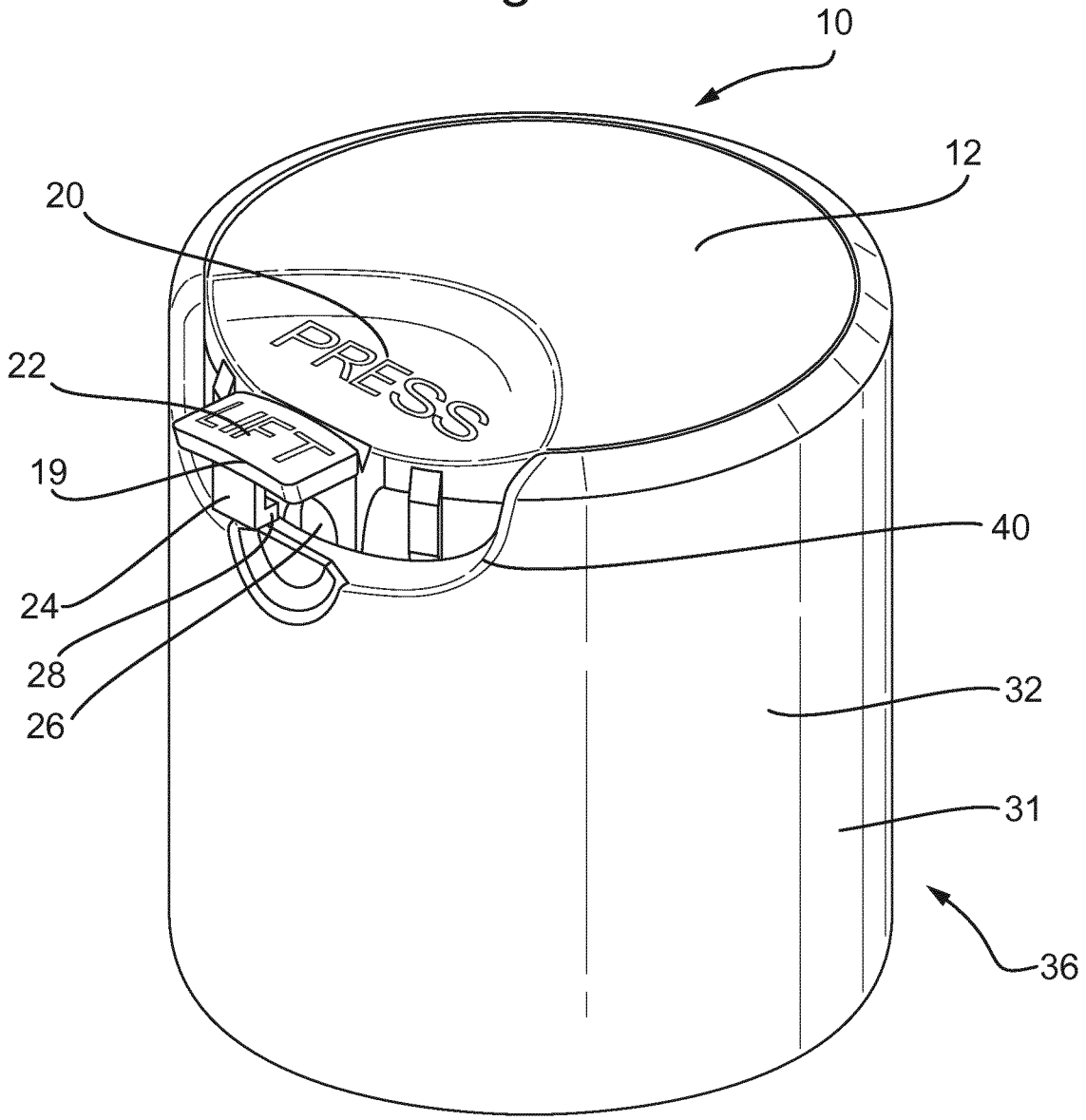
FIG. 6 is a perspective view of the actuator in place on the closure body in the actuator-closed but unlocked position.
Figure 7:
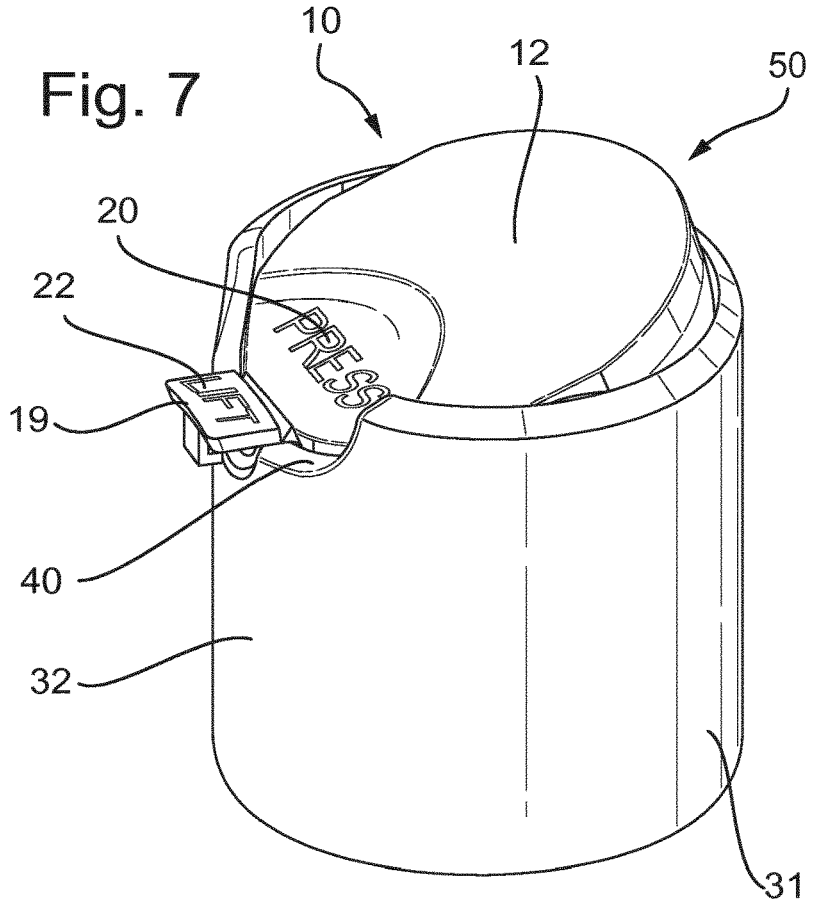
FIG. 7 is a perspective view of the actuator in place on the closure body and in the unlocked and actuator-open position.

When it is desired to dispense product from the container, extension panel 22 is lifted upwardly thereby removing latch 24 from aperture 26, so that actuator 10 is in the position shown in FIG. 6. With surface 19 of extension panel 22 no longer contacting the bottom surface of cutout 40, the actuator is free to rotate out of the closed position into the open position as shown in FIG. 7.

The adaptor and living hinge will typically be made of polypropylene or polyethylene. Post consumer polypropylene may be included as well. The adaptor and/or living hinge may also be made from the hinge material described in Domoy et al. U.S. Pat. No. 9,637,626, namely a molded article having a hinge, the molded article being a polymer, the polymer comprising a mixture of a first high-density polyethylene (HDPE) resin and a second HDPE resin, that is different than the first HDPE, wherein, when mixed: the first high-density polyethylene (HDPE) resin has:

a. a Melt Index ($I_{2,16}$) of about 0.5 dg/min to 10 dg/min, b. a Density of about 0.940 g/cm3 to 0.968 g/cm3, and c. a Melt Flow Ratio ($I_{21.6}$:$I_{2.16}$) greater than about 25; and the second HDPE resin has a Melt Flow Ratio ($I_{21.6}$:$I_{2.16}$) of less than about 30. The disclosure of Domoy et al. U.S. Pat. No. 9,637,626 is hereby incorporated by reference herein. The closure will generally be fabricated using injection molding.

An alternative claim could be: The combined actuator and closure base according to claim 9 wherein the actuator includes an opening in an outer wall and the extension panel rests on a surface of the opening when the actuator is in the locked position.

It should be understood, of course, that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A pivotable disc closure actuator comprising a) a closing surface comprising a product dispensing opening at a front thereof, b) at least two pivots on the closing surface, wherein the actuator is characterized by the closing surface including a skirt depending therefrom and comprising the product dispensing opening at a front thereof, c) an extension panel extending from a peripheral wall of the closing surface and having a locked and an unlocked position, d) the pivots being intermediate the product opening and the extension panel, and e) the extension panel having a latch member extending inwardly toward the closing surface when the extension panel is in the locked position, wherein in the locked position a bottom surface of the extension panel prevents force from rotating the actuator out of the closed position, the extension panel being attached to the actuator by a hinge.

2. The pivotable disc closure actuator according to claim 1 wherein the closing surface is generally circular, the opening is within a first arc of 120 degrees at the front of the closing surface, the extension panel is within a second arc of 120 degrees at a rear end of the closing surface, and the pivots are each within third and fourth arcs of 60 degrees each on opposite sides of the closing surface, the third and fourth arcs being intermediate the first and second arcs.

3. The pivotable disc closure actuator according to claim 1, further comprising a latch retainer for securing the panel extension and keeping the closing surface in the closed position.

4. The pivotable disc closure actuator according to claim 1, wherein the actuator includes an aperture or indentation for receiving the latch member.

5. The pivotable disc closure actuator according to claim 1, further comprising an aperture.

6. The pivotable disc closure actuator according to claim 1, further comprising a living hinge directly or indirectly connecting the extension panel to the closing surface.

7. The pivotable disc closure actuator according to claim 1, further comprising a finger-receiving depression in the closing surface adjacent the extension panel.

8. The pivotable disc closure actuator according to claim 1, in combination with a closure base comprising I) an opening suitable for receiving the pivotable closure, II) at least two surfaces on which the pivots can rest when the closing surface is received within the closure base, the combined pivotable closure and closure base further comprising a latch retainer on one or both of the pivotable closure and closure base suitable for receiving and securing the latch member when the extension panel is in the locked position.

9. The combined pivotable closure actuator and closure base according to claim 8, wherein the closing surface is generally circular, the opening is within a first arc of 120 degrees at the front of the closing surface, the extension panel is within a second arc of 120 degrees at a rear end of the closing surface, and the pivots are each within third and fourth arcs of 60 degrees each on opposite sides of the closing surface, the third and fourth arcs being intermediate the first and second arcs.

10. The combined pivotable closure actuator and closure base according to claim 8, further comprising a latch retainer for securing the panel extension and keeping the closing surface in the closed position.

11. The combined pivotable closure actuator and closure base according to claim 8, wherein the actuator includes an aperture or indentation for receiving the latch member.

12. The combined pivotable closure actuator and closure base according to claim 8, wherein the actuator comprises an aperture.

13. The combined pivotable disc closure actuator and closure base according to claim 8, further comprising a living hinge connecting the extension panel to the closing surface.

14. The combined pivotable closure actuator and closure base according to claim 8, further comprising a finger-receiving depression in the closing surface adjacent the extension panel.

15. The combined pivotable disc closure actuator and closure base according to claim 8, further comprising a finger receiving depression or aperture in the closure base below and adjacent to the extension panel when the panel is in the locked position.

* * * * *